US007628373B2

(12) United States Patent
Kokenes et al.

(10) Patent No.: US 7,628,373 B2
(45) Date of Patent: Dec. 8, 2009

(54) SIGN PANEL HOLDER

(75) Inventors: James G. Kokenes, Westmont, IL (US); Grant Donald Dicke, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 219 days.

(21) Appl. No.: 11/498,700

(22) Filed: Aug. 3, 2006

(65) Prior Publication Data

US 2008/0029660 A1 Feb. 7, 2008

(51) Int. Cl.
*A45B 25/28* (2006.01)
*A47G 25/12* (2006.01)

(52) U.S. Cl. ..... 248/534

(58) Field of Classification Search ..... 248/519, 248/539, 146, 158, 170, 188.6
See application file for complete search history.

(56) References Cited

U.S. PATENT DOCUMENTS 4,433,935 A * 2/1984 Main et al. ..... 403/385
4,888,894 A 12/1989 Brown, Jr.
5,609,317 A * 3/1997 Glynn et al. ..... 248/206.5
6,606,809 B2 * 8/2003 Hillstrom et al. ..... 40/610

* cited by examiner

*Primary Examiner*—J. Allen Shriver, II
*Assistant Examiner*—Erin Smith
(74) *Attorney, Agent, or Firm*—Olson & Cepuritis, Ltd.

(57) ABSTRACT

A receiver for a sign panel having a vertical rib defines upper and lower spaced-apart internal cavities, one of which receives the vertical rib and the other of which receives a vertical support from a sign stand, for example. A catch extends into the upper cavity so as to engage the rib. The invention finds particular application with sign panel supporting ribs which have plastic pockets fitted thereto to reduce wear and tear on the rib end.

19 Claims, 13 Drawing Sheets

SIGN PANEL HOLDER

FIELD OF THE INVENTION

The present invention relates to sign stands and especially such stands for displaying highway safety signs and the like.

BACKGROUND OF THE INVENTION

Highway and traffic safety signs are used in different circumstances to provide a warning to motorists and pedestrians that extra caution should be exercised in the immediate area. Warning signs may be of a permanent nature so as to warn, for example, of a railroad or school crossing. However, work crews are also deployed to temporary location sites as the need arises. When a work site is located on or adjacent a roadway, motorists especially, but also pedestrians need to be advised that greater caution should be exercised and that some deviation in normal traffic patterns may be necessary.

Warning signs employed in these and similar instances may be required for a prolonged period of time as when major road repairs are being conducted, or may be required for only a brief portion of time, such as a portion of a work day. Accordingly, in response to the need for temporary warning signs, various arrangements for so-called "portable" signs and sign stands have been proposed. Originally, the sign panels for such temporary warning signs were made with warning indicia applied to a rigid substrate. Over time, improvements were realized by putting warning indicia on a flexible panel which could be folded or rolled for easy storage. In order to consistently provide the proper display for the indicia, the flexible panel, when brought out of storage, needed to be stretched in a flat, planar configuration. One popular arrangement to provide this feature includes a pair of lightweight flexible ribs which eventually came to be made of fiber reinforced molded polymeric material. The two ribs are typically pivotally joined at their centers to allow the ribs to be rotated between an overlying position for storage and a display position where the ribs are located at 90 degrees to one another, with one rib being vertically aligned and the other being horizontally aligned.

The need therefore arose to support the flexible sign panel from a stand in order to ensure that the vertical rib maintains a desired vertical position despite wind loading and gusts from nearby traveling vehicles. At first, the bottom end of the vertical rib was simply telescopically inserted in a socket, typically made of metal, located at the top of the sign stand. It was found desirable to be able to readily disconnect the sign panel and its supporting ribs from the sign stand, allowing both components to be collapsed for compact storage in a vehicle used to transport workmen and material to and from a roadside job site. However, the bottom end of the vertical rib tended to become frayed, splitting or cracking due to the repeated contact with the sign stand base.

U.S. Pat. No. 4,888,894 provided a plastic pocket to cover the bottom end of the vertical rib, shielding and protecting the rib while the pocket is telescopically inserted and removed from the sign stand base. U.S. Pat. No. 4,888,894 also provided a releasable securement arrangement for securing the plastic pocket and enhance the sign panel in the sign stand. However, the arrangement has been found inadequate in a number of ways. For example, the construction of the socket or pocket receiver portion of the sign stand is relatively massive, requiring a number of special machining operations for its manufacture and assembly. Also, the socket body was welded to form an open ended tubular shape, only a portion of which was filled with the plastic pocket. Most of the upper end of the socket is open to the element and hence tend to corrode, accumulates rain, sleet and other moisture which becomes trapped in the interior of the socket assembly.

The release lever of U.S. Pat. No. 4,888,894 is actuated in an upward direction to allow release of the pocket and hence the sign panel, contrary to an intuitive inclination to the depress the operating level for such purpose. Further, the socket was constructed in such a way that only minimal points of contact were made between the plastic pocket and the surrounding metal structure of the socket holding the plastic pocket in position. The lever operated release includes a metallic hook portion which is spring loaded for lever action and which is deflected by the plastic pocket during insertion of the pocket in the sign stand. The metal to plastic contact, especially when repeated during numerous set up and take down operations has been found to result in accelerated wear of the plastic pocket. Further, the metal to plastic contact becomes more difficult as the metal surface contacting the plastic pocket has increased friction characteristics caused by abrasion of its surface and corrosion from moisture and roadside salt spray during winter months. Accordingly, the need has arisen for an improved sign stand support for temporary signage display for warning and other types of indicia.

SUMMARY OF THE INVENTION

The present invention provides a novel and improved sign stand holder that minimizes the disadvantages associated with prior art holders and provides advantages in construction, mode of operation and use. One embodiment of the sign stand holder comprises a body defining upper and lower spaced-apart internal cavities, disposed one above the other. The upper cavity has an upwardly facing opening for receiving a vertical rib of a sign panel, and a lower cavity having a downwardly facing opening for receiving a support member, such as an upright support of a sign stand. A latch is carried by the body so as to have at least a portion thereof extending into the upper cavity so as to engage the rib. In this embodiment, the rib can be understood as comprising either a rib, or a rib having a protective plastic pocket fitted thereto, as will be described herein.

In another embodiment, a sign stand assembly comprises the aforedescribed sign panel holder in combination with a base having a plurality of support legs and an upright member extending above the base and received in the lower cavity of the sign panel receiver.

DETAILED DESCRIPTION OF THE PREFERRED EMBODIMENTS

Figure 1:
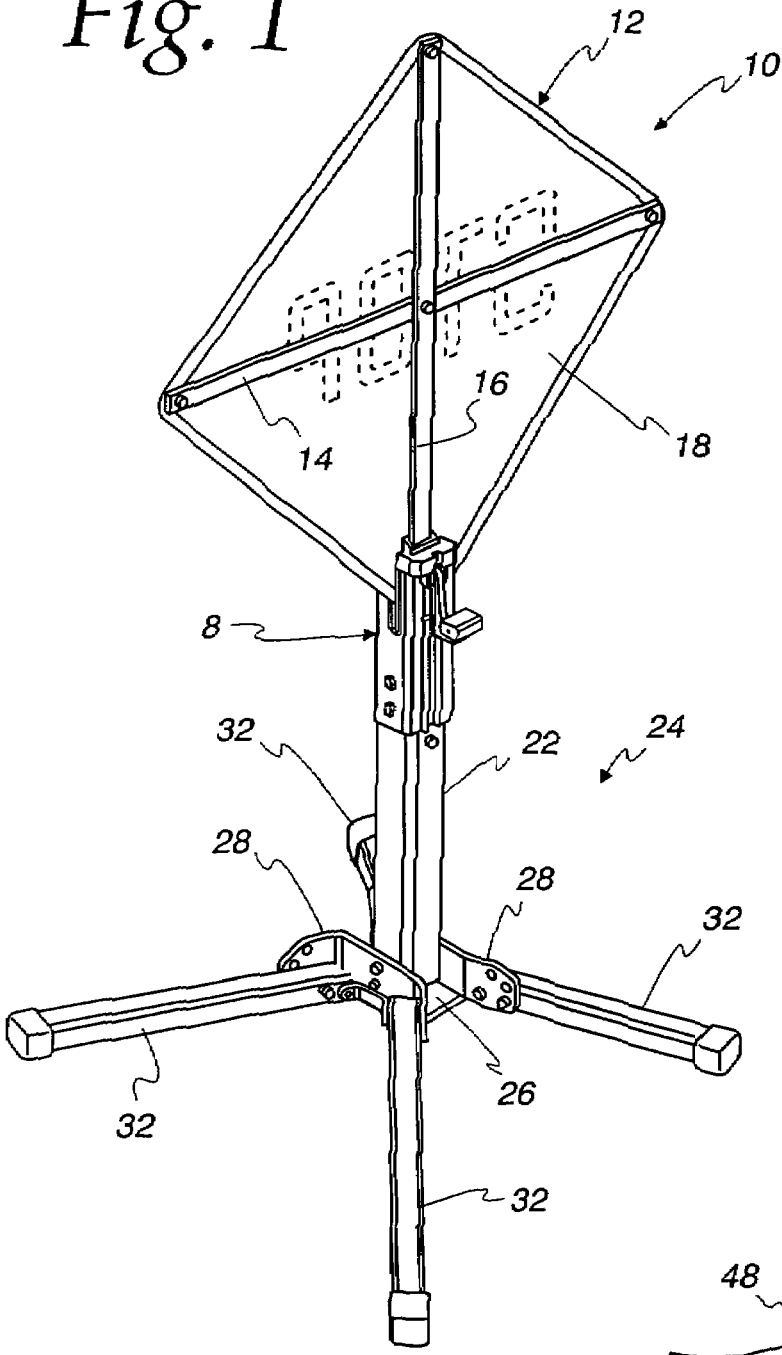
FIG. 1 is a perspective view of a sign stand and sign panel assembly.

Referring now to the drawings, and initially to FIG. 1, a sign panel and sign stand assembly is generally indicated at 10. A portion thereof, sign panel assembly 12, includes a sign panel 18 made of fabric or other flexible material supported by a horizontal rib 14 and a vertical rib 16. The cross ribs 14, 16 are joined together at their centers by a rivet or other fastener that allows the ribs to be rotated from the display position illustrated in FIG. 1 to a storage position where the ribs are aligned to overlie one another and with the fabric panel 18 rolled about the ribs, for compact storage. A sign panel holder is generally indicated at 8 and includes an socket connector or open tubular bottom for receiving the upper portion of a tubular upright member 22 of a sign stand assembly generally indicated at 24. The sign stand assembly further includes a central support portion 26 with ears 28 for pivotally supporting a plurality of legs 32 between the open or displayed position illustrated in FIG. 1 and a closed or storage position with the legs folded so as to extend generally parallel to upright member 22. Sign panel holder 8 also includes an upwardly facing opening for receiving the lower portion of sign panel assembly 12.

Figure 2:
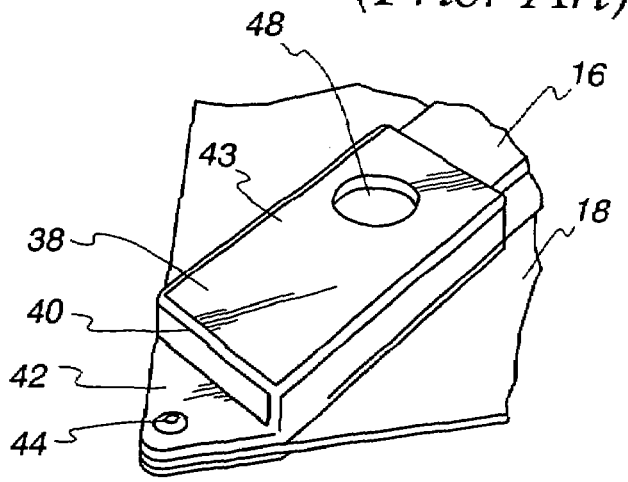
Fig. 2 (Prior Art)
FIG. 2 is a perspective frontside view of the lower portion of a sign panel assembly having a first type of plastic pocket.
Figure 3:
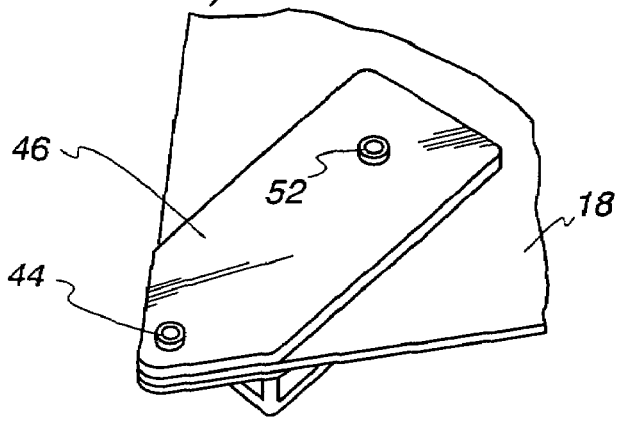
Fig. 3 (Prior Art)
FIG. 3 is a perspective backside view of the arrangement of FIG. 2.

Turning now to FIGS. 2 and 3 a fragmentary portion of a sign panel assembly 12 is shown in perspective. A plastic pocket 38 receives the bottom portion of vertical rib 16 and includes a triangular extension portion 42 which is secured by a rivet fastener 44 to a backing plate 46 shown in FIG. 3. Plastic pocket 38 includes a bottom wall 40 extending between triangular extension 42 and a face 43 in which hole 48 is formed. Rivet fastener 44 extends through fabric panel 18 and presses plastic pocket 28 and backing plate 46 together so as to compressibly engage the lower portion of fabric panel 18. A hole 48 is formed in the base of the plastic pocket to allow application tooling to install a rivet fastener 52 through a back wall of plastic pocket 38 and through fabric panel 18 so as to engage backing plate 46. Thus, the bottom portion of vertical rib 16 and the bottom most corner of fabric panel 18 are surrounded by plastic material of the plastic pocket 38 and backing plate 46, to provide protection therefor. Further details concerning the plastic pocket and its matter of assembly can be found in U.S. Pat. No. 4,888,894 the disclosure of which is incorporated herein in its entirety as if fully set forth herein.

Figure 4:
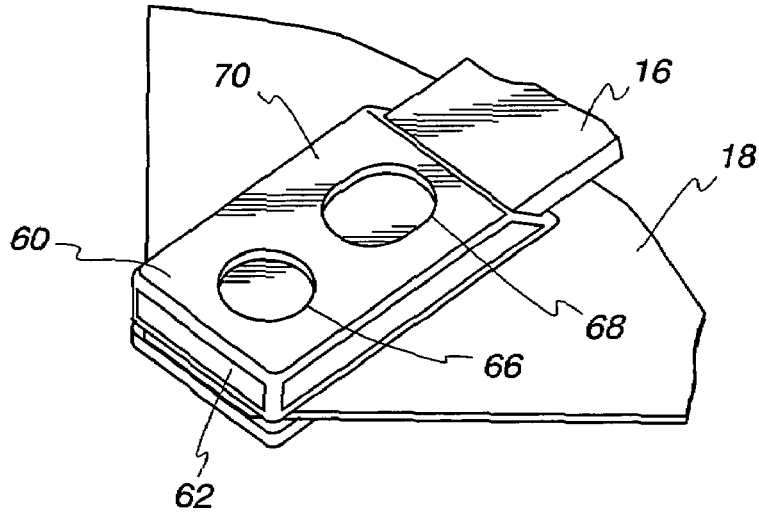
Fig. 4 (Prior Art)
FIG. 4 is a fragmentary perspective frontside view of the bottom portion of a sign panel assembly having a different type of plastic pocket.
Figure 5:
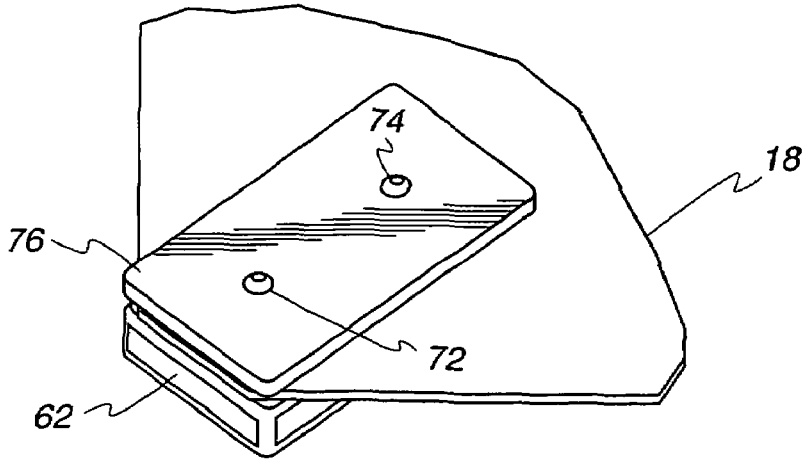
Fig5 (Prior Art)
FIG. 5 is a fragmentary perspective backside view of the arrangement of FIG. 4.

Referring now to FIGS. 4 and 5 an alternative plastic pocket construction is shown. Included is a plastic pocket 60 which receives the bottom end of vertical rib 16 and which has a generally flat bottom surface 62 covering the bottom end of fabric panel 18, the bottom most triangular portion thereof being truncated in the matter illustrated in the figures. Plastic pocket 60 includes holes 66, 68 to allow application tooling to fasten rivets 72, 74 to a generally rectangular backing plate 76, shown in FIG. 5. Holes 66, 68 are formed in face 70 of plastic pocket 60. Plastic pocket 60 is commercially available from the assignee of the present invention and is sold in combination with the fabric panel and the supporting ribs 14, 16.

Figure 6:
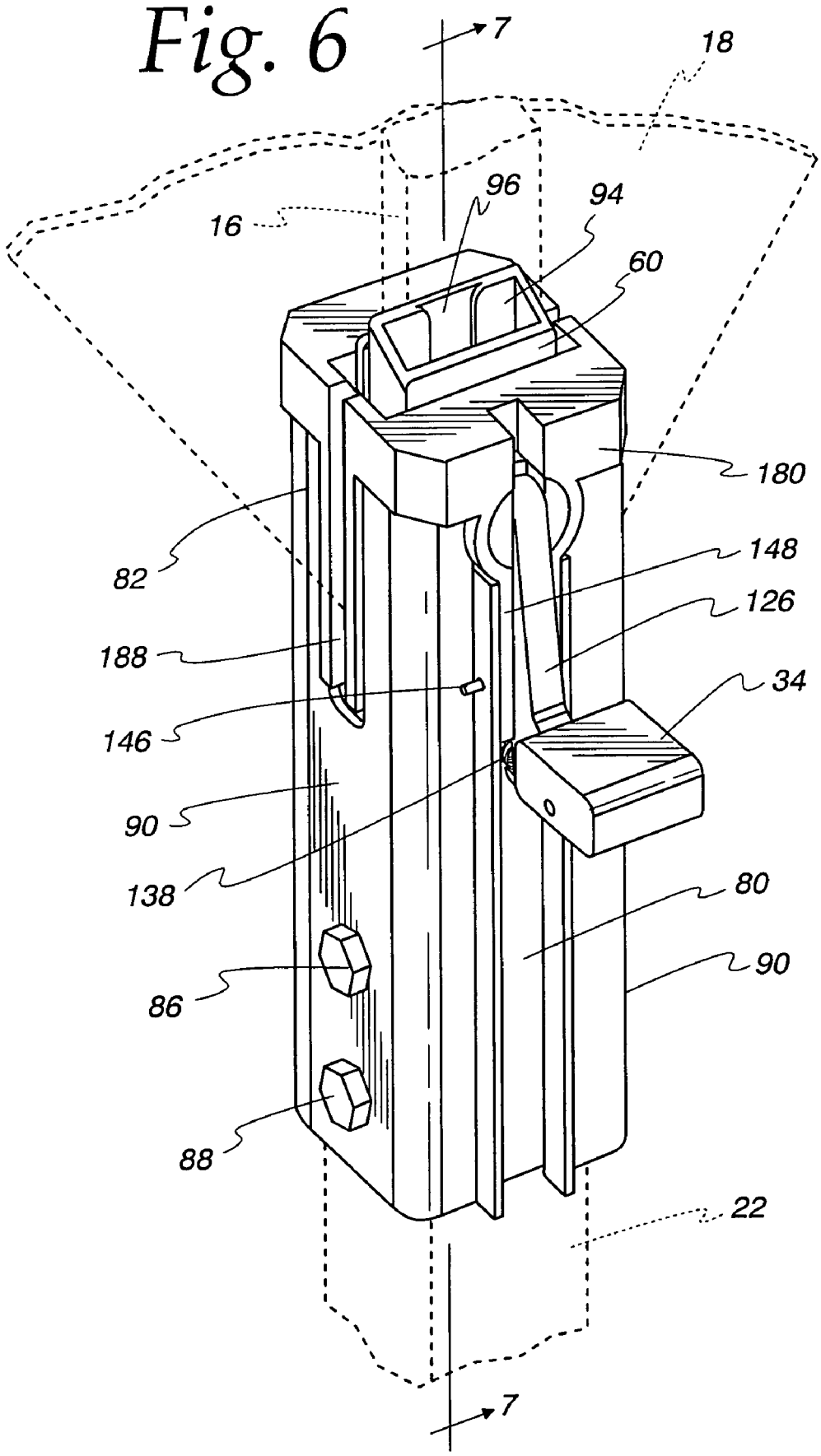
FIG. 6 is a perspective view of a sign panel holder, taken on an enlarged scale.

Turning now to FIG. 6, a first embodiment of a panel holder includes a body preferably formed of two mating body portions 80, 82 formed of a lightweight material such as plastic or aluminum. Plastic material is the preferred construction, and can be virtually any available type and preferably comprises a type of plastic material exhibiting resistance to surface abrasion and rough use. In practice, the panel holder is preferably permanently secured to the upper end of upright 22 which in a preferred form comprises metallic tubing. The panel holder is secured to upright 22 by cross bolts 86, 88 or other fasteners inserted through holes formed in overcap or shield 90, which is preferably made of metal, and less preferably of a rugged plastic composition. Since the panel holder is preferably permanently installed with upright 22, and hence the remainder of the sign stand assembly, it is typically subjected to rough handling as it is brought into and out of storage for use during temporary assignments.

Figure 8A:
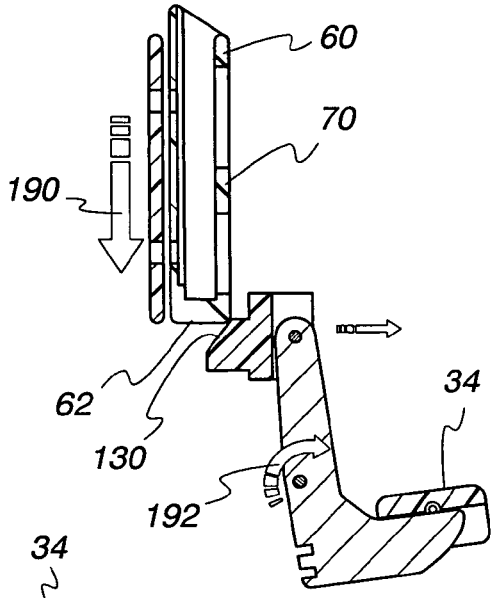
FIGS. 8*a* and 8*b* show a portion of the cross-sectional view of FIG. 7 indicating a sequence of operation.
Figure 8B:
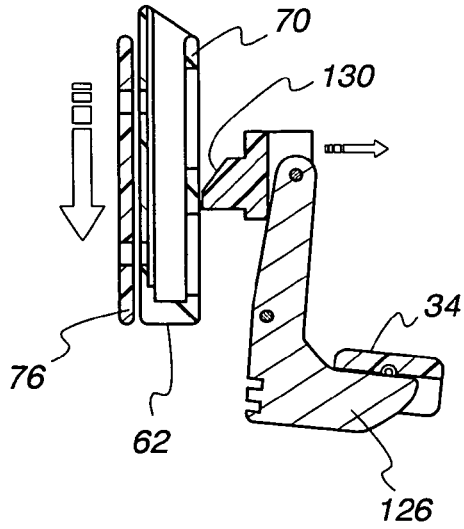
Figure 9:
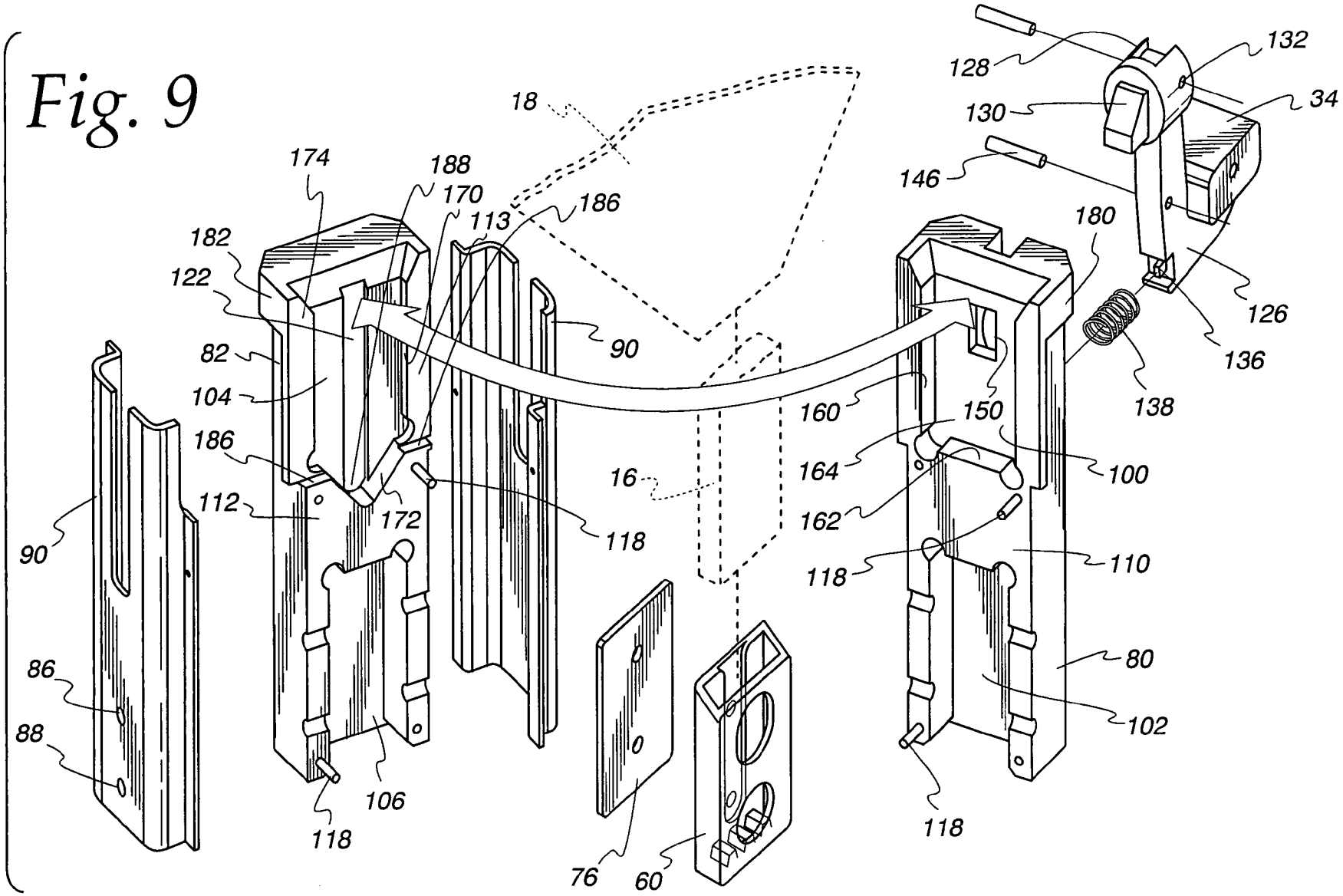
FIG. 9 is an exploded perspective view of the sign panel holder.
Figure 10:
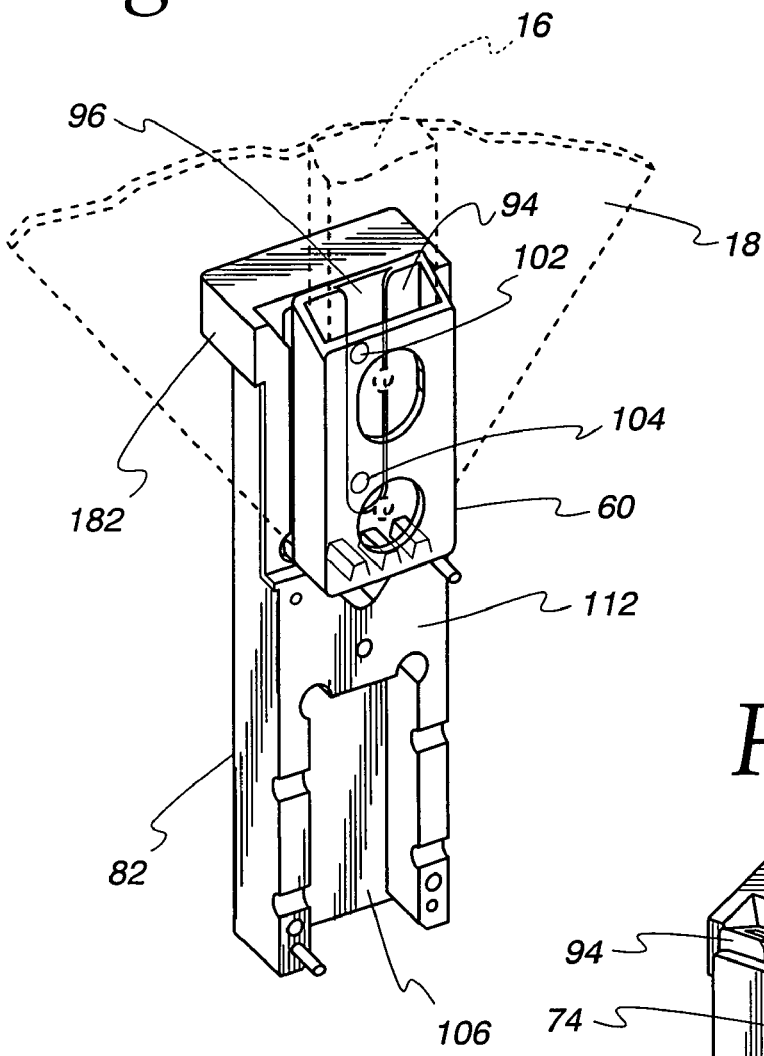
FIG. 10 is a perspective view of a first portion of the sign stand holder shown with a plastic pocket fully inserted therein.
Figure 11:
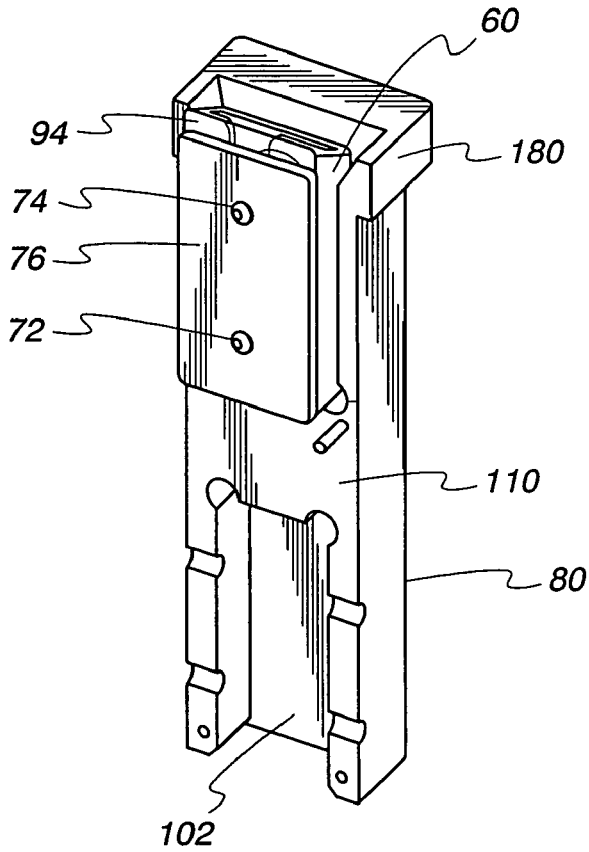
FIG. 11 is a perspective view of another portion of the sign panel holder with a plastic pocket fully inserted therein.

Turning now to FIGS. 7-11 and initially to FIG. 10 plastic pocket 60 includes a back wall 94 in which a recess 96 is formed to accommodate the heads of rivet fasteners 72, 74 (See FIG. 5) inserted through holes 102, 104 formed in back wall 94 as can be seen in FIG. 10. Referring to FIGS. 9-11, body portion 80 has upper and lower hollow cavities or recesses 100, 102 whereas body part 82 has upper and lower hollow cavities or recess portions 104, 106. Body portions 80, 82 have opposed mating faces 110, 112 which contact one another when brought together in the manner indicated by the arrow in FIG. 9 to produce the completed assembly shown for example in FIGS. 6 and 7. As can be seen in the right hand portion of FIG. 9, body portion 80 has associated therewith a plurality of pins 118 which are received in cooperating holes formed in body parts 80, 82 to help align the body parts during mating. If desired, suitable adhesive can be applied to the pins 118 and/or to the mating faces 110, 112 to help secure the body parts together and to maintain such securement throughout the life of the panel holder.

Figure 7:
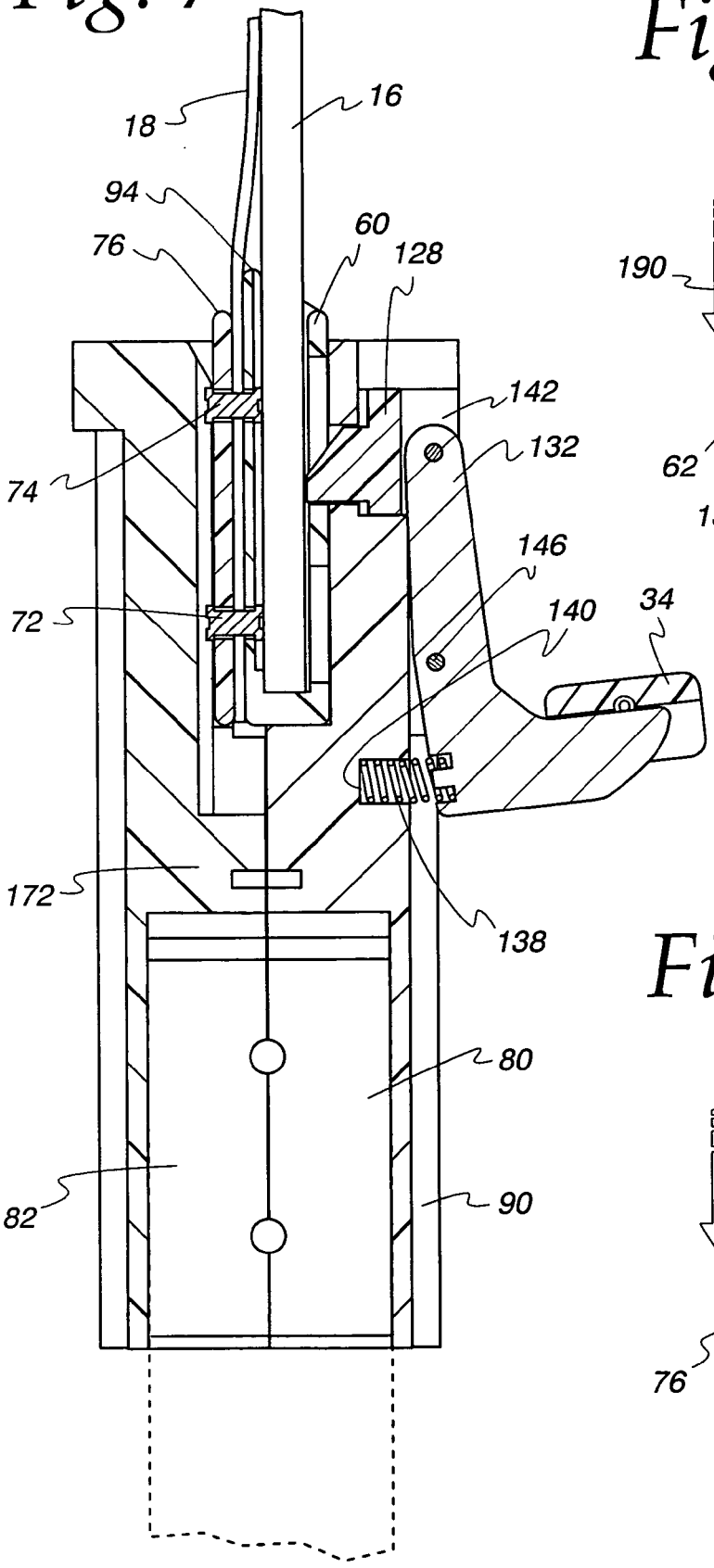
FIG. 7 is a cross-sectional view taken along the line 7-7 of FIG. 6.

Referring to FIG. 7 substantial moment forces are applied by the fabric panel to the lower portion of vertical rib 16 due to wind loading. With reference to FIG. 7, wind loading causes the bottom part of vertical rib 16 to move to the left and right. If desired, optional shields or overcaps 90 of metal or other suitable material can be applied in the manner indicated in the FIG. 6 to further ensure that the mating body parts 80, 82 are not separated during use. The construction of the panel holder using mating parts 80, 82 and guide pins 118 is one example of a possible economic construction of the panel holder. Other constructions will be explored, herein. For example, body portions 80, 82 can be molded as one unitary piece, or the body parts can be arranged in mating halves with a mating interface along the vertical center line of the panel holder, 90 degrees offset from the mating faces 110, 112. As another example, one or more bands of steel, plastic or other suitable material can be wrapped about the girth of the assembled body parts 80, 82 in addition to or in place of overcaps 90.

As indicated in FIG. 9, the upper cooperating recesses 100, 104 of body parts 80, 82 respectively, have different depths, with recess 104 being shallower and having a central groove 122 for receiving exposed heads of fasteners 72, 74 visible for example in FIG. 11. Preferably, the lower recesses 102, 106 of the body parts 80, 82 are mirror images of one another and when the body parts are mated together, form a rectangular cross-sectional passageway for receiving upright tubular member 22. Other cavity shapes, such as cylindrical or polyhedral shapes are possible. Each body part 80, 82 has cooperating recesses which together form through holes for fasteners 86, 88 passing through overcaps 90. If desired, through holes could be formed either additionally or in place of the illustrated through holes passing through overcaps 90, so as to extend generally horizontally but in the direction displaced 90 degrees so as to pass through the longitudinal center lines of the body parts 80, 82. Other arrangements can be adapted for maintaining a secure engagement of body parts 80, 82.

Referring to FIG. 9, lever pad 34 is attached to a lever arm 126 which has an upper end that receives a tooth-like engaging member 128 having a beveled face 130 and secured to arm 126 by a pin 132, or a screw or other securement. A slot is formed in the raised shoulder 148 of body part 80 to receive arm 126. The slot is indicated at 142 in FIG. 7. If desired, engagement member 128 can be secured to arm 126 by adhesive or if a metal composition is desired, may be formed integrally with the metal stock from which arm 126 is formed. A socket 136 holds one end of coil spring 138 captive. Referring to FIG. 7, the opposed end of coil spring 138 is held captive in a recess 140 formed in body part 80. An adjacent, slot 142 is formed in body part 80 to confine arm 126 as the arm is pivoted about pin 146. As can be seen in FIG. 6, for example, the arm passes through raised shoulder 148 formed on the exterior face of body part 80. The slot 142 shown in FIG. 7 confines lateral movement of the arm 126 as it is operated between its rest position indicated in FIG. 7 and its depressed position indicated for example FIG. 8*b*. As indicated in the figures, engagement member 128 is secured to arm 126 by a pin. If desired, other types of securement such as a threaded screw or rivet could be employed. As can be seen in FIG. 9, a passageway 150 is formed in body part 80 to allow passage of retainer member 130 therethrough, as the retainer member is moved between its engaged and disengaged positions.

As mentioned, the lower recesses 102, 106 of body parts 80, 82 are generally mirror images of one another. In contrast, upper recess 104 is made slightly longer than its cooperating recess 100 formed in body part 80. The additional length of recess 104 includes an extended bottom portion of generally triangular shape, to receive the lower triangular extension 42 of pocket 38, shown for example in FIG. 2. Recess 100 in body part 80 may be described as being formed by a pair of opposed side walls 160, a lower wall 162, and a front wall 164. The upper end of the body part forming recess 100 is beveled as can be seen for example in FIG. 9. The upper mating cavity of body part 82 is formed by opposed side walls 170, bottom walls 172, and rear wall 174 in which groove 122 is formed. As with the upper recess 100 of body part 80, the upper recess 104 of body part 82 is also formed to create a beveled opening. The beveled openings of the body parts 80, 82 are reinforced by collars 180, 182 formed in body parts 80, 82, respectively.

Referring again to the top left corner of FIG. 9, the upper end of groove 122 is also beveled to provide camming action as the exposed heads of fasteners 72, 74 enter the top of the completed panel holder assembly. The mating face 110 of body part 80 is continuous or planar from the top to the bottom of the body part. In contrast, the upper portion 113 of mating face 112 is recessed so as to form internal walls 186. This construction results in a triangular slot 188 to allow passage of the lower triangular portion 42 of pocket 38. As can be seen, it is generally preferred that slot 188 be formed in one half portion, namely the body part 82.

Referring to FIGS. 10 and 11, the plastic pocket 60 is shown confined within each half portion of the panel holder, that is, in each body part 80, 82. As indicated in FIGS. 10 and 11, three sides of the plastic pocket are engaged and supported by body part 80, whereas two sides of the plastic pocket are engaged and supported by body part 82. With reference to FIGS. 4, 5 and 9, the bottom wall 62 of plastic pocket 60 (see FIG. 5) is supported by bottom wall 162 of recess 100, the thicker recess of the two recesses 100, 104 formed in body parts 80, 82. Side walls of the plastic pocket are supported by side walls 160 forming recess 100, as illustrated in FIG. 9.

Referring to body part 82 and the recess 104 formed therein, the sidewalls of the plastic pocket are supported by side walls 170 forming recess 104. Additionally, if the plastic pocket 38 shown in FIGS. 2 and 3 is used, additional support is provided by wall 172 shown in FIG. 9 which supports the triangular extension portion 42 of plastic pocket 48. In addition, the major surfaces of either plastic pocket 38 or 60 engage the front wall 164 and rear wall 174, forming recesses 100, 104 in body parts 80, 82, respectively. The exposed fasteners holding the plastic pockets to their respective backing plates are supported by the wall forming groove 122 formed in body part 82. Additionally, as indicated in FIG. 7, a substantial portion of the outer surface of the plastic pocket is supported by intimate contact with the interior surfaces of the body parts 80, 82.

In use, the panel assembly 12 is mated to the sign stand assembly 24 by inserting the lower end of the vertical rib 16, the lower end of panel 18 and substantially the entirety of the plastic pocket into the internal cavity formed by recesses 100, 104 of body parts 80, 82. Upon initial insertion into the panel holder, as indicated in FIG. 8*a*, the bottom corner of the plastic pocket is brought into contact with the sloped or beveled camming surface 130 of retention member 128 (FIG. 9). With continued insertion in the direction of arrow 190, the bottom corner of plastic pocket deflects the lever arm 126, causing the lever arm to rotate in the clockwise direction of arrow 192, lowering the lever pad 34 as illustrated in FIG. 8*b*, which arises when the face of retaining member 128, located below camming surface 130 rides on the exposed face 70 of plastic pocket 60 (or alternatively, the exposed face 63 of plastic pocket 38). The plastic-to-plastic engagement of the pocket with the retaining member 130 is facilitated by the lubricious nature of those plastic components. When the plastic pocket is fully seated within the panel holder, in the manner indicated in FIG. 7, spring 138 biases lever arm 126 in the clockwise direction so as to assume a stationary, rest position indicated in the figure.

As can be seen from the above, panel holders provided by the present invention offer a number of substantial advantages. For example, the internal wall 172 formed between the upper and the lower recesses (see FIG. 7) provides a full support for the pocket bottom wall and additionally, when a pocket with a triangular extension is employed, internal walls 172 of the mating body part provide additional support for the pocket bottom. Further, body part 82 includes a groove 122 for guiding and supporting the exposed rivet head of the plastic pocket assembly, providing additional lateral support for the pocket and sign supported thereby. As another feature made available with the present invention, the retaining member 128 can be formed of plastic or other desirable material to provide improved camming action as the pocket is inserted into the panel holder. Only small amounts of material are needed for the economical construction of retainer member, which makes a wide variety of materials available for the purpose. As a further advantage, the panel holder according to the present invention is preferably made of a lubricious material such as plastic or oil impregnated sintered bronze which reduces abrasion on the outer surfaces of the plastic pockets and eliminates the possibility of galvanic action or rust bonding the panel holder to the upright support.

As can be seen for example in FIG. 7, the panel holder according to the present invention includes an internal wall between the upper and the lower cavities, stopping water migration as when rain or other moisture enters the top of the panel holder. If desired, one or more drain holes can extend through the plastic body parts, such as body part 82, adjacent the bottom of the upper recesses, to drain away any water trapped in those recesses. Improved economical construction is possible with panel holders according to the present invention. No longer is it necessary to provide heavy, expensive weldments. Instead, economical one piece of two piece plastic molding are now possible. As can be seen from the above, the downward operation of the lever to release the plastic pocket is easier and more intuitive. Compared to prior art arrangements, the handle assembly is simplified in construction and operation and can be made from a fewer number of less expensive parts. In particular, the lever arm can be stamped from steel metal in a simple one-step operation. As mentioned, the panel holder can accommodate two styles of plastic pockets and provides improved "full contact" support for each type of plastic pocket. Further, as can be seen in FIG. 7, a snug fit is provided with the panel assembly, reducing the possibly for moisture to enter the top of the panel holder, once the panel assembly is inserted.

It will be appreciated that receivers described herein offer special advantages when employed with ribs having plastic pockets. However, the receivers could also be employed to support ribs and other structural members lacking a plastic pocket, but having instead a detent or hole for receiving the retention member. Further, if desired, the receivers described herein can be provided with a second spring-loaded retention member extending into the bottom cavity so as to releasably engage an upright member of a sign stand or other support.

Figure 12:
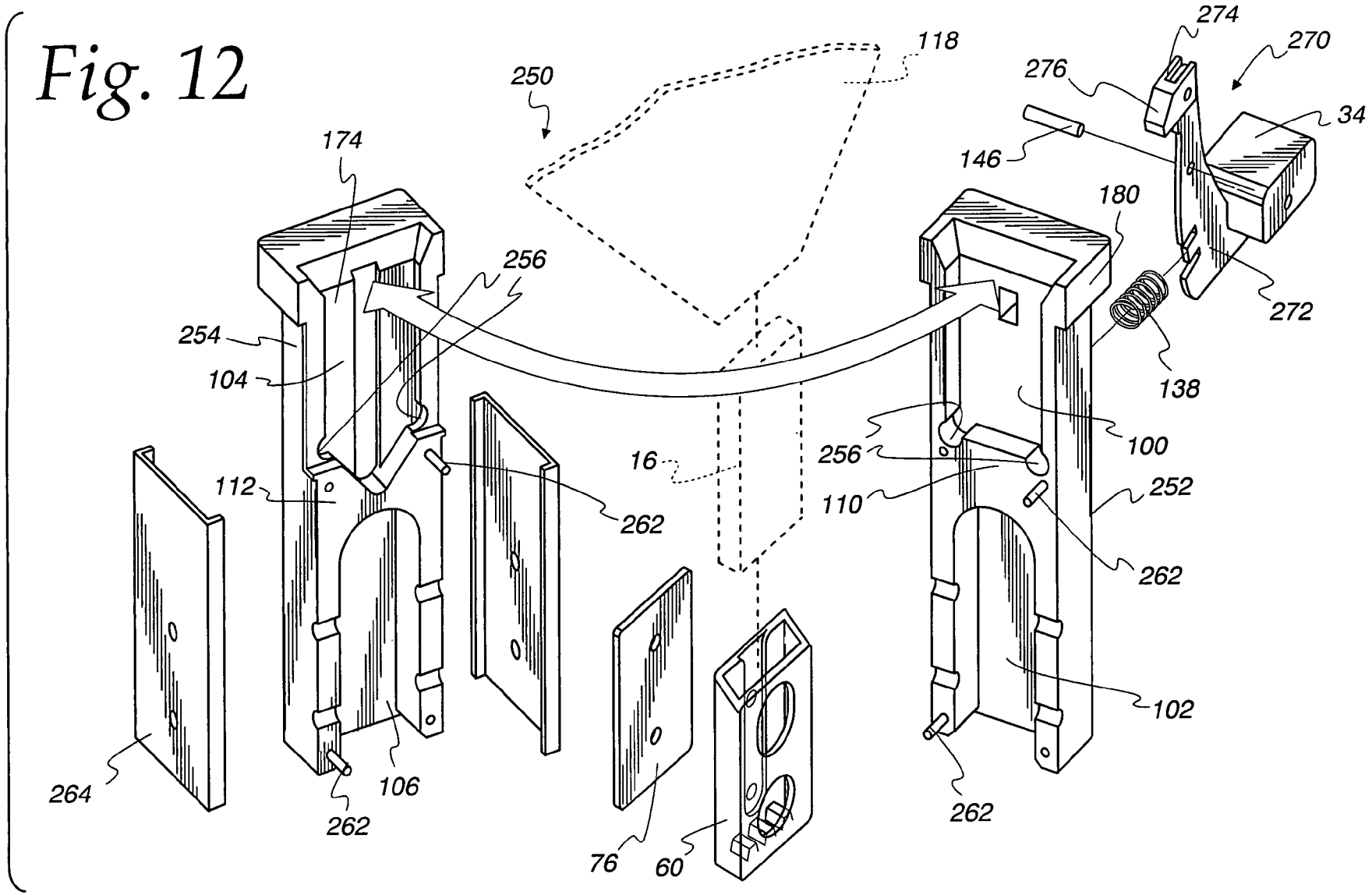
FIG. 12 is an exploded perspective view of another sign panel holder.

Referring now to FIG. 12, an alternative sign panel holder assembly is generally indicated at 250. The body parts 252, 254 illustrated in FIG. 12 generally resemble the body parts 80, 82 illustrated in FIG. 9, except for certain differences. For example, the lower recesses 102, 106 formed in body parts 252, 254 respectively, have rounded upper ends, as illustrated so as to reduce internal stresses and to avoid the need for corner radiuses 256, such as those formed in the upper recesses 100, 104, which are preferred but not required in all instances. As a further refinement, panel holder assembly 250 has alignment pegs 262 formed at alternating positions on the mating body parts 252, 254. Also shown in FIG. 12 are shield or overcap numbers 264 having a simplified, generally rectangular form, and which could also be employed in other embodiments in panel holder assemblies described herein. Overcaps 264 define holes aligned in registry with the recesses in body parts 252, 254 adjacent the lower recesses thereof, to allow through-bolts or similar fasteners to secure a panel holder assembly to a support post.

Also shown in FIG. 12 is an alternative catch member generally indicated at 270 which includes an integral arm 272. A catch or locking ear 274 has a beveled face 276 which serves a similar function to the beveled face 130 shown in FIG. 9, for example. Catch 274 is preferably formed of plastic or other lubricious material and is pinned to the upper end of arm 272 so as to be retained therewith. It is generally preferred that catch 274 be allowed to pivot slightly about the upper end of arm 272 to allow a free movement as the catch is engaged and disengaged with the plastic pocket. If desired, however, the tip of catch 274 can be provided with a rounded bottom surface which follows an arc centered at the fulcrum point where the arm is mated to pin 146. In this manner, the catch can be rigidly mounted to the arm and a smooth interaction between the catch and the plastic pocket will be assured when the catch engages and is removed from the hole formed in the face of the plastic pocket.

Figure 13:
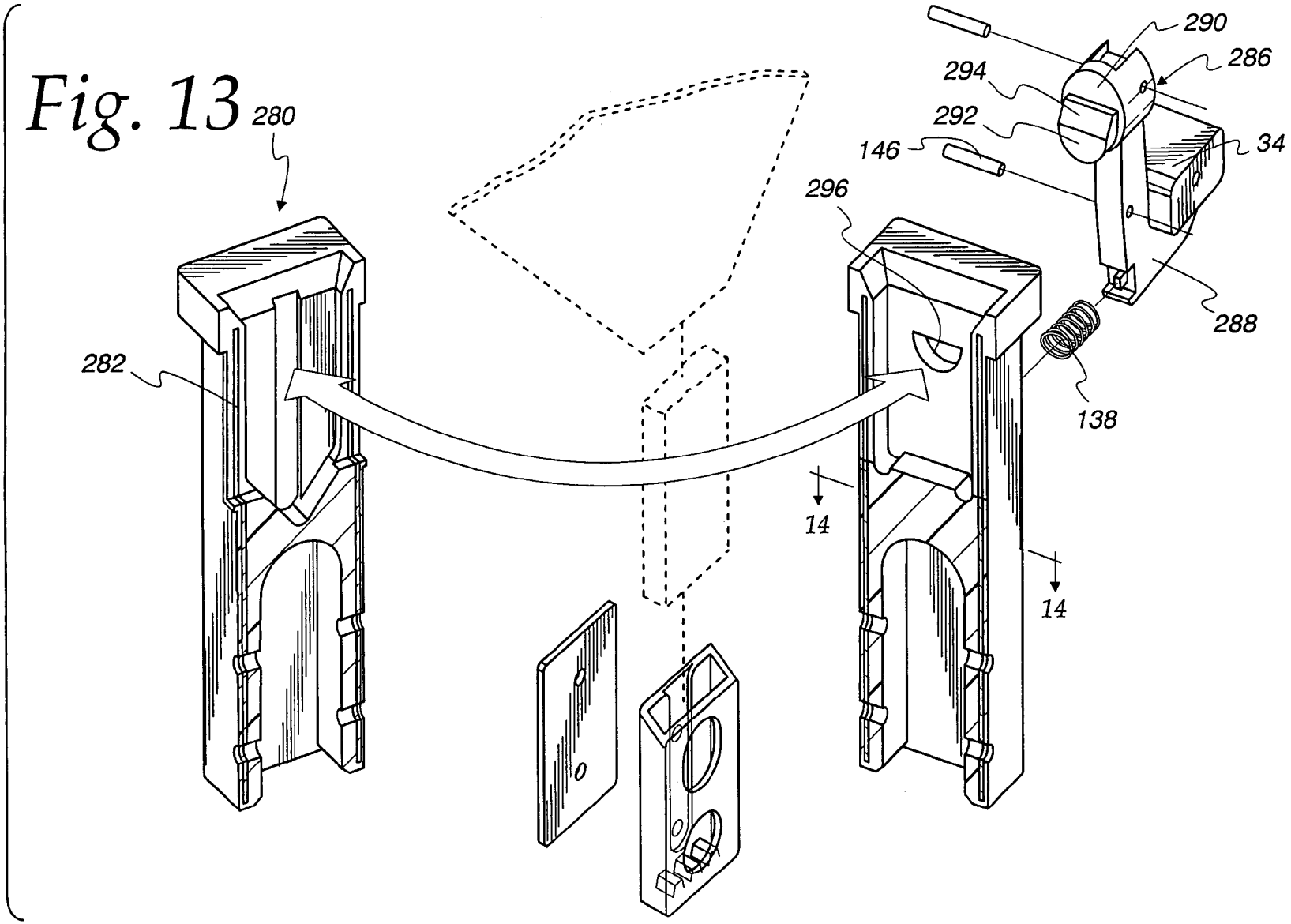
FIG. 13 is an exploded perspective view of another sign panel holder.
Figure 14:
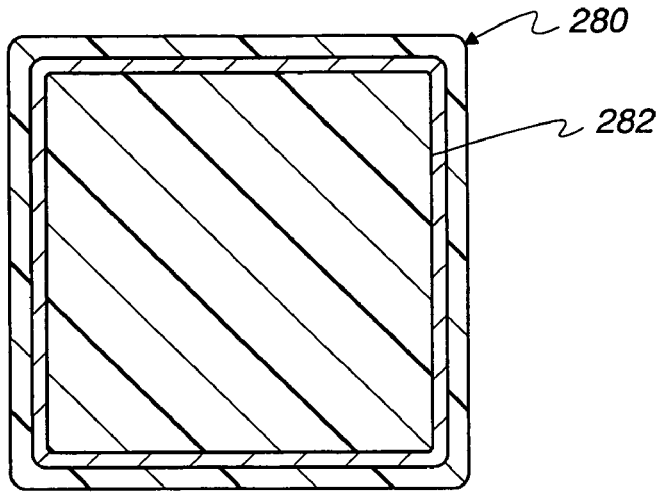
FIG. 14 is a cross-sectional view taken along the line 14-14 of FIG. 13.

Turning now to FIG. 13 an alternative panel holder is generally indicated at 280. Preferably, the panel holder is integrally formed of molded plastic or other similar material so as to surround an internal, embedded support 282. As can be seen in FIG. 14, internal support 282 preferably has a hollow tubular form. Preferably, support 282 is formed of metal, but could be made from other materials, as desired. Also shown in FIG. 13 is a catch member 286 comprising an arm 288, preferably formed as a single piece of metal, rigid plastic or other suitable material. A head 290 is pinned to the upper end of arm 288 and includes a projecting catch 292. With comparison to the beveled face 130 of FIG. 9, the beveled face 294 of catch 286 is made wider, and the bottom rounded surface of catch 292 is enlarged, so as to closely conform to the size of the hole in the plastic pocket in which it is received. The through hole 296 is enlarged so as to accommodate the catch 292 which projects therethrough during operation of the panel holder. Preferably, the remaining features of the integral body of panel holder 280 are substantially similar to other embodiments of panel holders described herein. For example, the lower recess of panel holder 280 has a rounded upper end, in a manner similar to the construction illustrated in FIG. 12.

Figure 15:
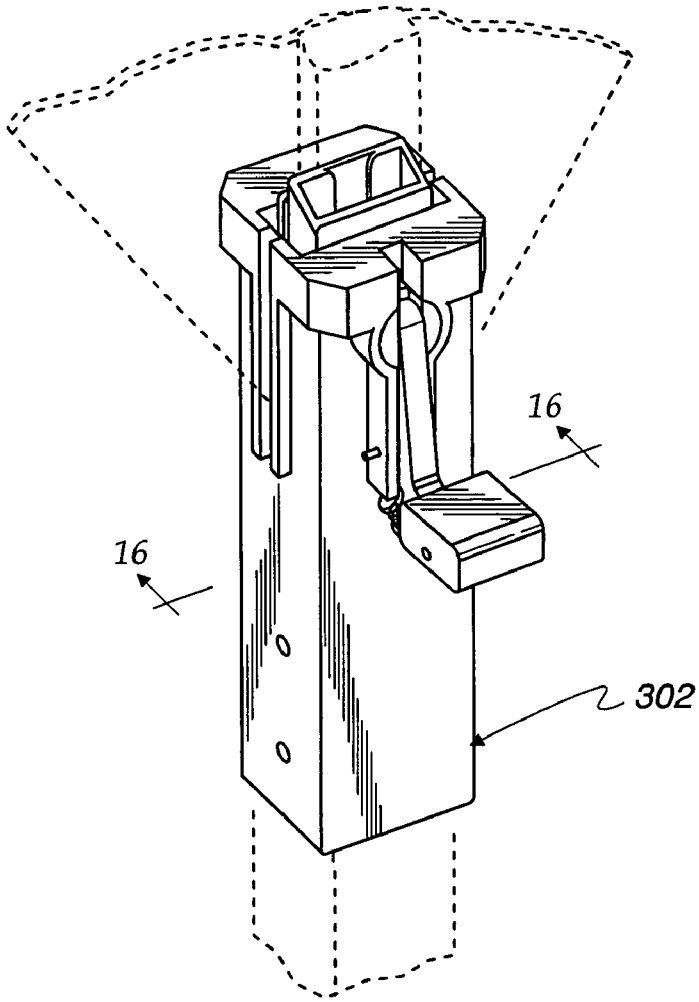
FIG. 15 is a perspective view of another sign panel holder.
Figure 16:
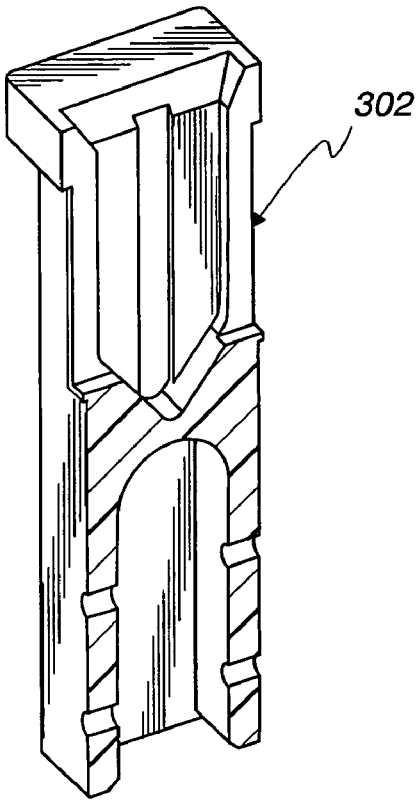
FIG. 16 is a cross-sectional view taken along the line 16-16 of FIG. 15.

Turning now to FIGS. 15 and 16, an alternative panel holder is generally indicated at 302 and generally resembles the panel holder illustrated in FIG. 6, except that the body of panel holder 302 is formed as a single monolithic piece of molded plastic or other suitable material. In certain instances, it is preferred to use stronger and therefore more costly materials to form panel holder 302 as a single molded piece. Improved economical constructions such as the two-part body illustrated in FIG. 7 can be employed, if desired. As a further alternative, if the body of the two-part panel holders described herein is made of a stronger material, it may be possible to eliminate the shields or overcaps described herein, making possible the advantages attained with the single monolithic body illustrated in FIGS. 15 and 16.

Figure 17:
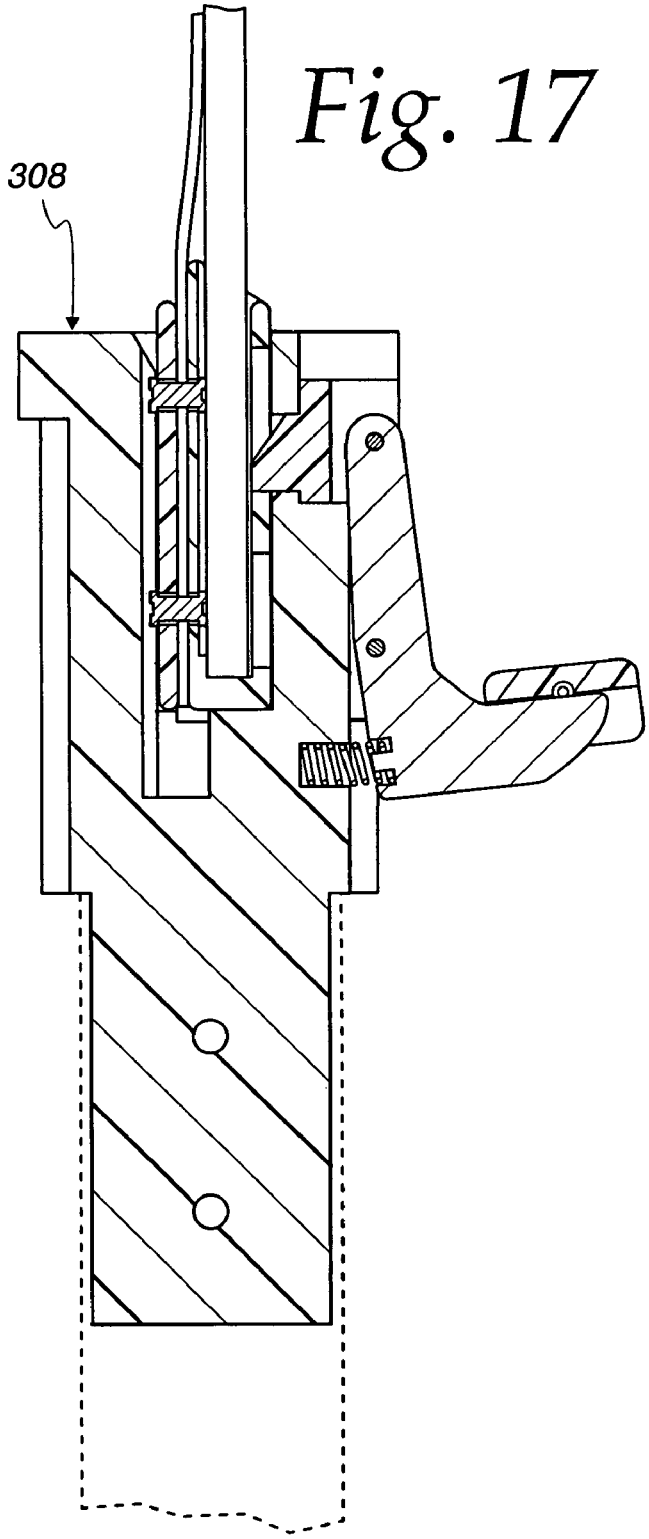
FIG. 17 is a cross-sectional view of another sign panel holder.

Referring now to FIG. 17, an alternative panel holder 308 has a one-piece monolithic body similar to that described above with reference to FIGS. 15 and 16. However, in place of the lower cavity which receives the support post, the lower end of the body of panel holder 308 has a plug shape and is dimensioned so as to be received within an upright or support post, schematically indicated by the dotted lines in FIG. 17. Although the plug portion is shown in a solid form, it could also be made to have one or more internal recesses.

Figure 18:
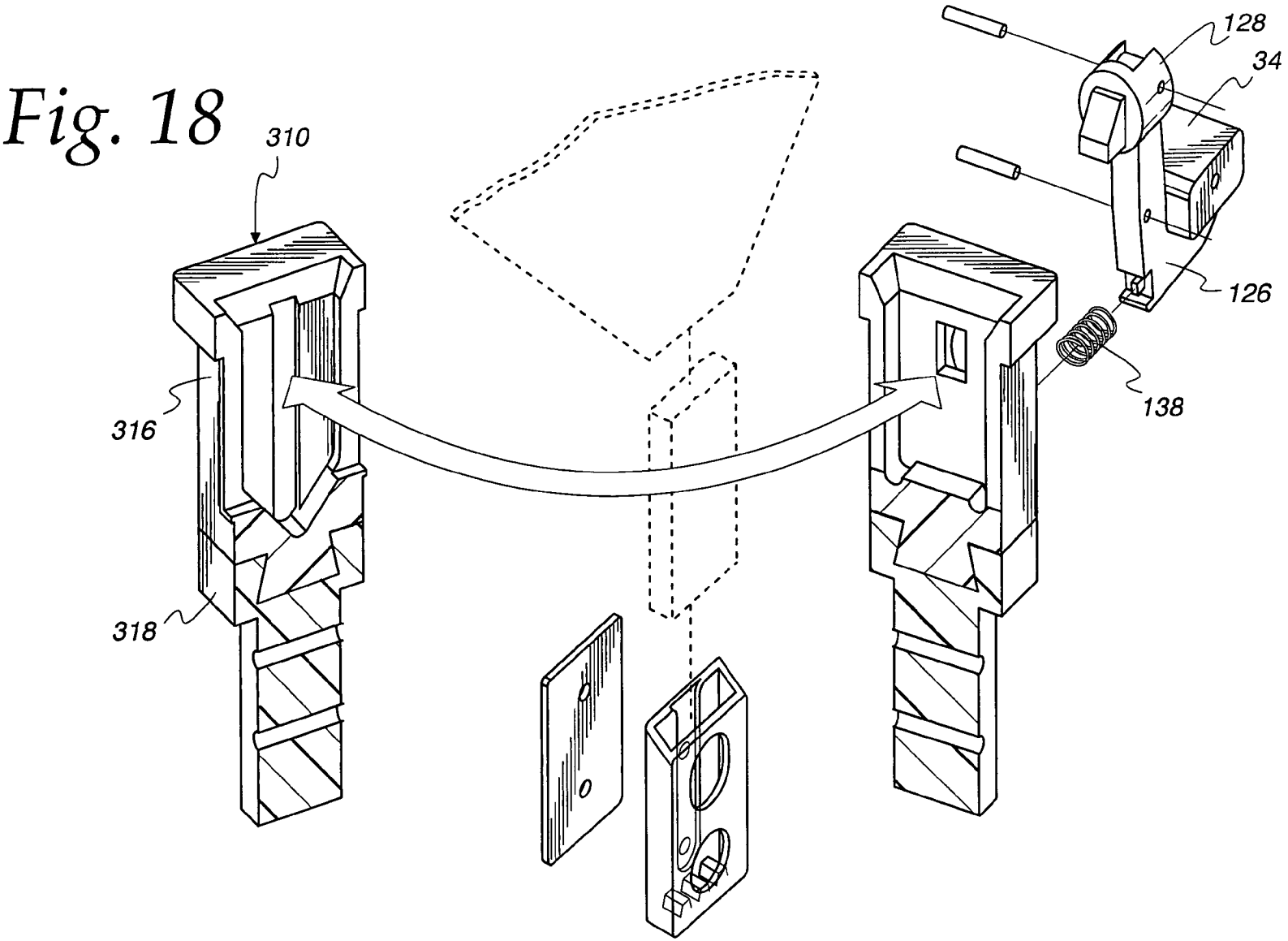
FIG. 18 is an exploded perspective view of another sign panel holder.
Figure 19:
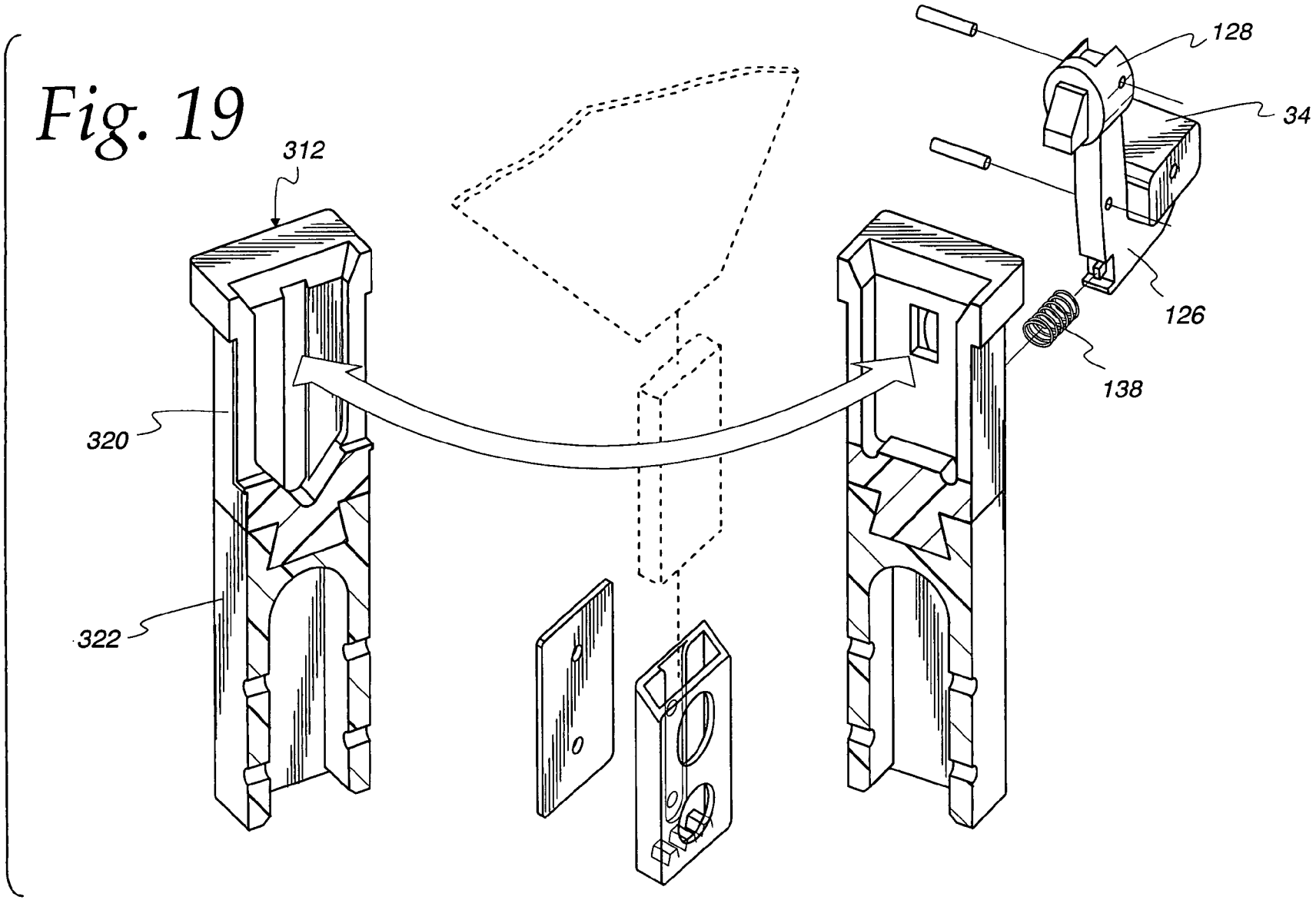
FIG. 19 is an exploded perspective view of another sign panel holder.

Turning now to FIGS. 18 and 19, two piece panel holders are generally indicated at 310 and 312, respectively. Panel holder 310 generally resembles the panel holder 308 of FIG. 17, except being formed from upper and lower body parts 316, 318. In a similar manner, panel holder 312 is formed from upper and lower body parts 320, 322. Panel holder 310 shown in FIG. 18 has a plug-type bottom portion for insertion into a support post, whereas panel holder 312 shown in FIG. 19 has a hollow bottom portion designed to telescopically receive a support post.

Figure 20:
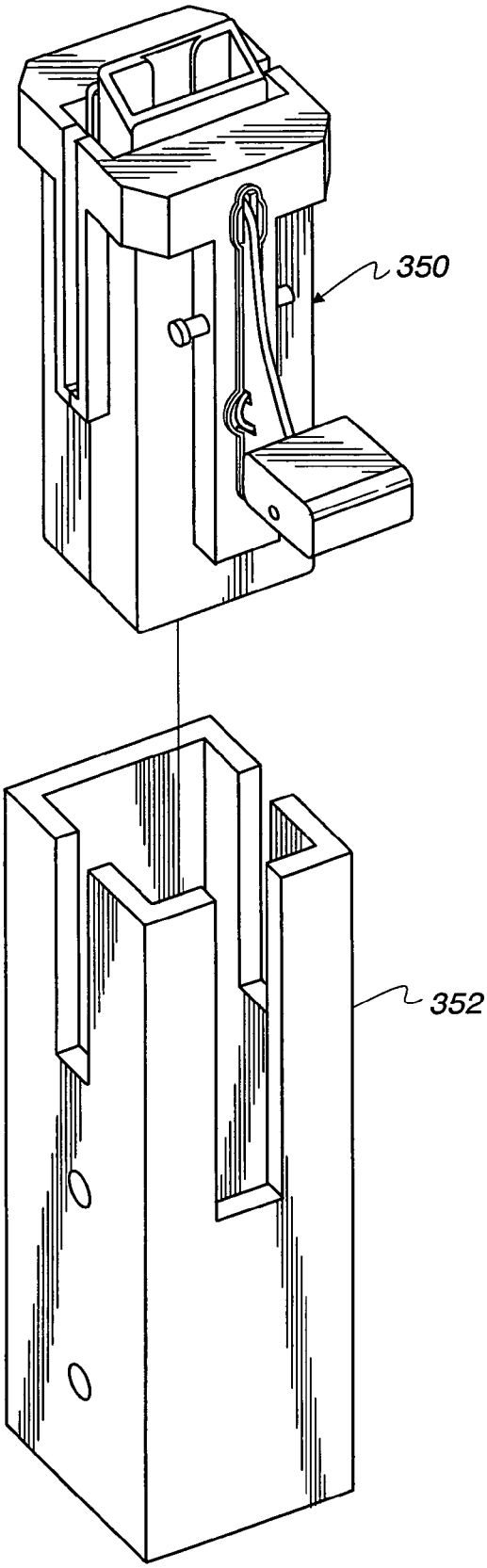
FIG. 20 is an exploded perspective view of another sign panel holder.

Referring now to FIG. 20, an alternative sign panel receiver is shown comprising an upper assembly 350 for telescopic insertion within a slotted metal tube 352. Assembly 350 is substantially identical to the top half portion of the assembly shown in FIG. 12. Included are the arm, retention member, spring and lever pad shown in FIG. 12, fitted with the upper portion of the plastic body forming upper cavities 100, 104 (see FIG. 12). If desired, the plastic body of assembly 350 can be made from either a single monolithic molded piece or two mating half portions as shown in FIG. 12. During assembly, upper portion 350 is fitted as an insert within metallic tube 352. Due to the inherent strength of the unitary structure of tube 352, the body of upper portion 350 can be made of less expensive light weight materials. Upper portion 350 is retained within tube 352 by pins or threaded fasteners, not shown, or plastic body of upper portion 350 can include outward locking projections received within holes or detents formed in tube 352. Alternatively, adhesive could be used if desired. Note that the upper portion of tube 352 is completely sealed against the elements whenever portion 350 is fully inserted therein, thereby reducing internal corrosion within the tube. If greater corrosion prevention is required, tube 352 may be formed of plastic or other corrosion resistant material such as copper or brass. Further, it may be desirable in certain instances to provide tube 352 with a generally cylindrical shape in which case the plastic body of upper portion 350 could be molded so as to have a generally cylindrical exterior surface for a close fit engagement with the tube.

If desired, any of the variously configured pivoting catches can be interchanged with any of the panel holder bodies described herein. Further, it will be appreciated various other features can be interchanged among the various embodiments described herein, as will become apparent from studying the appended description and drawings.

These and other advantages variations and optional features are made possible with the present invention. It will be understood that the foregoing relates only to a preferred embodiment of the invention, and that numerous changes and modifications may be made therein without departing from the spirit and scope of the invention as defined in the following claims.

We claim:

1. A receiver assembly for use with a sign panel having a vertical rib, the receiver comprising:

a rib pocket defining an internal cavity for receiving the lower end of the vertical rib, and having a pair of opposed walls with a first wall having an aperture defined by a latching edge and a bottom wall between said opposed walls;

a backing plate secured to the second wall of the rib pocket with a fastener;

a receiver comprising an elongated body extending along a generally vertical longitudinal axis, having opposed upper and lower ends and defining a generally enclosed upper cavity receiving the rib pocket, disposed above a generally enclosed lower cavity for receiving the upper end of an upright support member;

the body defining an upper opening at its upper end, communicating with the upper cavity, the upper opening surrounded by a camming surface to guide the rib pocket to the opening;

the body defining a lower opening at its lower end, communicating with the lower cavity;

the body including a stop surface extending to the upper cavity so as to interfere with the bottom wall of the rib pocket inserted in the upper cavity;

a lever movably supported by the body for movement between latching and retracted positions, the lever having first and second portions, with the second portion extending outside of the body, for access by a user to move the latch member toward the retracted position; and a latch member carried on the first portion of the lever for movement between a latching position extending into the upper cavity so as to engage the latching edge of the rib pocket inserted therein, and a retracted position disengaged from the latching edge of the rib pocket.

2. The receiver of claim 1 wherein said body defines a pair of opposed slots communicating with said upper cavity.

3. The receiver of claim 1 wherein said lever arm is pivotally supported by said body.

4. The receiver of claim 1 wherein said lever arm is biased to move said latch member to the latching position.

5. The receiver of claim 1 wherein said body comprises a pair of mating half portions.

6. The receiver of claim 5 further comprising a pair of overcap members spanning at least a portion of said pair of mating half portions.

7. The receiver of claim 1 wherein said body is monolithically formed of plastic material.

8. The receiver of claim 1 wherein said body comprises a rigid insert disposed within an outer covering.

9. The receiver according to claim 1 further comprising a bias member carried on the body, biasing the latch member toward the latching position.

10. The receiver according to claim 1 wherein the upper and the lower cavities are generally coaxially aligned.

11. The receiver according to claim 1 wherein the latch member has a camming surface engaging the rib member for movement of the latch member toward the refracted position.

12. The receiver assembly according to claim 1 wherein the backing plate is secured to the second wall of the rib pocket with a second fastener and the first wall of the rib pocket defines a second aperture adjacent the second fastener.

13. A sign stand assembly for supporting a sign panel having a vertical rib with a lower end, comprising:

a base including a plurality of support legs;

an upright member extending above said base and having an upper end;

a rib pocket defining an internal cavity for receiving the lower end of the vertical rib, and having a pair of opposed walls with a first wall having an aperture defined by a latching edge and a bottom wall between said opposed walls;

a backing plate secured to the second wall of the rib pocket with a fastener;

a receiver comprising an elongated body extending along a generally vertical longitudinal axis, having opposed upper and lower ends and defining a generally enclosed upper cavity receiving the rib pocket, disposed above a generally enclosed lower cavity receiving the upper end of the upright member;

the body defining an upper opening at its upper end, communicating with the upper cavity, the upper opening surrounded by a camming surface to guide the rib pocket to the opening;

the body defining a lower opening at its lower end, communicating with the lower cavity;

the body including a stop surface extending to the upper cavity so as to interfere with the bottom wall of the rib pocket inserted in the upper cavity;

a lever movably supported by the body for movement between latching and retracted positions, the lever having first and second portions, with the second portion extending outside of the body, for access by a user to move the latch member toward the retracted position; and a latch member carried on the first portion of the lever for movement between a latching position extending into the upper cavity so as to engage the latching edge of the rib pocket inserted therein, and a retracted position disengaged from the latching edge of the rib pocket.

14. The sign stand assembly of claim 13 wherein said body comprises a pair of mating half portions.

15. The sign stand assembly of claim 14 further comprising a pair of overcap members spanning at least portions of said pair of mating half portions.

16. The sign stand assembly of claim 13 wherein said body is monolithically formed of plastic material.

17. The sign stand assembly according to claim 13 wherein the latch member has a camming surface engaging the rib pocket for movement of the latch member toward the retracted position.

18. The sign stand assembly according to claim 17 further comprising a bias member carried on the body, biasing the latch member toward the latching position.

19. The sign stand assembly according to claim 13 wherein the backing plate is secured to the second wall of the rib pocket with a second fastener and the first wall of the rib pocket defines a second aperture adjacent the second fastener.

* * * * *